US006336609B1

(12) United States Patent
Johnsson

(10) Patent No.: US 6,336,609 B1
(45) **Date of Patent: *Jan. 8, 2002**

(54) METHOD AND DEVICE FOR A FIN-STABILIZED BASE-BLEED SHELL

(75) Inventor: Stig Johnsson, Karlskoga (SE)

(73) Assignee: Bofors Defence Aktiebolag, Karlskoga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/381,517

(22) PCT Filed: Mar. 11, 1998

(86) PCT No.: PCT/SE98/00437

§ 371 Date: Nov. 2, 1999

§ 102(e) Date: Nov. 2, 1999

(87) PCT Pub. No.: WO98/43037

PCT Pub. Date: Oct. 1, 1998

(30) Foreign Application Priority Data

Mar. 25, 1997 (SE) ..... 9701090

(51) Int. Cl.[7] ..... F42B 10/14; F42B 10/32

(52) U.S. Cl. ..... 244/3.29; 102/490

(58) Field of Search ..... 102/374, 376, 102/489, 490; 244/3.27–3.3

(56) References Cited

U.S. PATENT DOCUMENTS 4,498,394 A * 2/1985 Regebro ..... 102/490
4,546,940 A * 10/1985 Andersson et al. ..... 244/3.29
4,699,334 A * 10/1987 Boeder ..... 244/3.29
4,736,908 A * 4/1988 Boder ..... 244/3.29
4,944,226 A * 7/1990 Wedertz et al. ..... 102/476
5,103,734 A * 4/1992 Arnaud et al. ..... 102/489

FOREIGN PATENT DOCUMENTS

SE 339646 B 10/1971
SE 432670 B 4/1984
SE 442782 B 1/1986

* cited by examiner

*Primary Examiner*—Harold J. Tudor
(74) *Attorney, Agent, or Firm*—Connolly Bove Lodge & Hutz, LLP

(57) ABSTRACT

The present invention relates to a method and a device relating to shells with deployable fins and which are fired from large caliber guns into ballistic trajectories, for preventing the propellant gas pressure in the barrel during firing from directly or indirectly deforming the said fins (9–13). The type of fins that the present invention primarily relates to are those that are deployed on command in order to fin-stabilize the shell. Usually such fins are protected prior to deployment by an ejectable fin protector (19). To prevent this fin protector from being deformed and consequently impeding fin deployment or degrading fin functionality, the present invention proposes that all unoccupied space inside the said fin protector be filled with an inert, noncombustible, non-glutinous substance (32) of low compressibility and very low inherent strength. This substance, which completely fills the space inside the fin protector around the fins (9–13), will detach from the fins after fin deployment as a result of mainly centrifugal forces, but until that point in time will effectively prevent all undesirable deformation of the fin protector and thereby indirectly of the fins. Until ejected the fin protector (19) is thus fully sealed.

14 Claims, 4 Drawing Sheets

METHOD AND DEVICE FOR A FIN-STABILIZED BASE-BLEED SHELL

Figure 1:
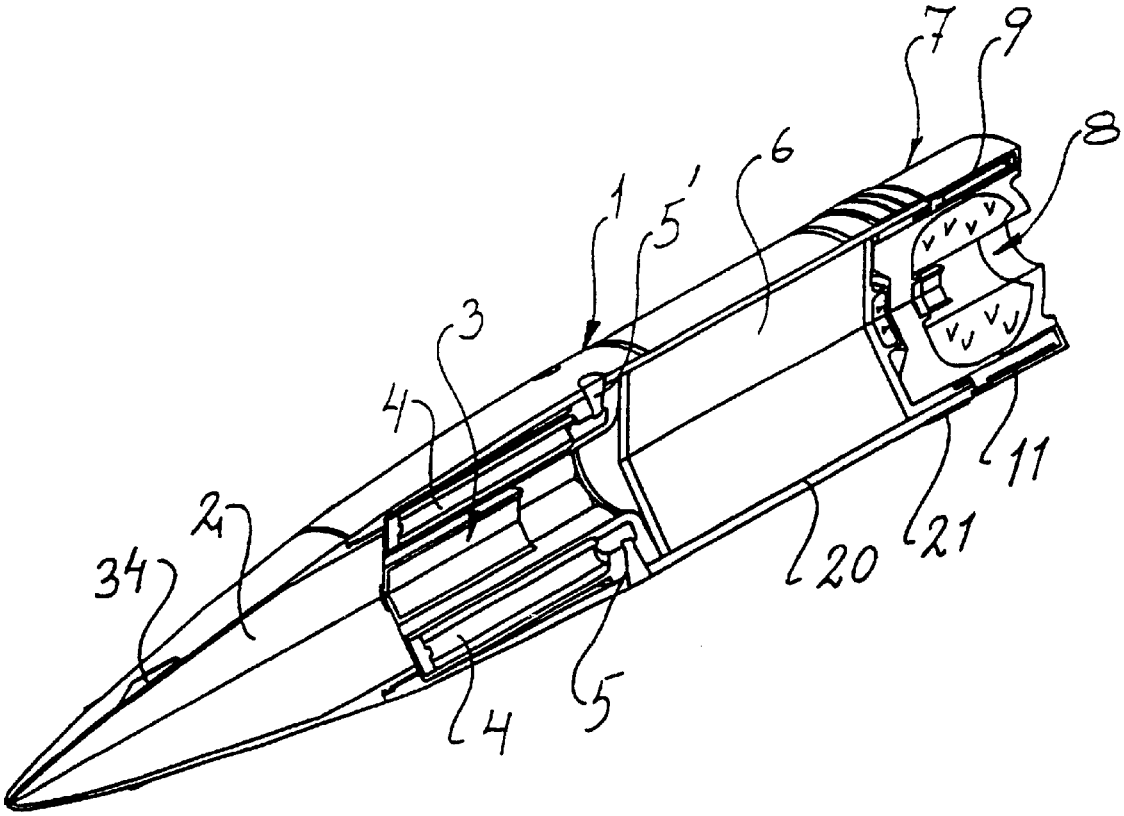

The present invention relates to a method and a device of importance for shells fired from rifled or smooth-bore gun barrels, which shells during at least some phase of their trajectory are fin-stabilized by fins that deploy from the body of the shell, and which fins during the initial firing phase until the point in time when their stabilizing function is actuated are hinged down against the casing of the shell and are protected by a protector or equivalent this is ejectable when the fins are to be deployed. Furthermore, the present invention is a method and a device that enables the driving band on such shells to be located at its most advantageous position without negatively affecting the shell during the firing phase with undeployed fins.

Artillery shells are usually spin-stabilized through their trajectory until impact with the target or self-detonation or, if the task is to disperse a cargo of, for example, bomblets, until the point in the trajectory at which this is implemented. There are also, however, numerous types of special shells that are spin-stabilized during a greater or lesser part of their trajectory. Shells which are spin-stabilized during a greater or lesser part of their trajectory can either be fired from the barrel with full spin and have the rate of spin decelerated in conjunction with fin deployment, or they can be fired from a rifled or smooth-bore barrel imparting little or no spin—in a rifled barrel by means of a slipping driving band, for example.

There may be several reasons for making an artillery shell fin-stabilized instead of in the simplest and most usual manner letting it be spin-stabilized, but in the case of trajectory correctable munitions or terminally guided shells whose trajectories can be corrected by means of command activated thruster rockets, deployable deceleration devices, guidance devices or equivalent, it is almost an absolute requirement. It is namely much more difficult to correct the trajectory of a fully spin-stabilized body than to carry out an equivalent correction for a fin-stabilized one. As fin-stabilized shells usually have a significantly greater air resistance than corresponding spin-stabilized shells it is usually appropriate, as in the manner indicated above, to allow a shell to begin its trajectory as spin-stabilized and not to go over to fin-stabilizing until the shell approaches its target.

A number of different design principles already exist for using deployable fins for fin-stabilized projectiles. If the projectile in question during the firing phase as well as during a greater or lesser part of its trajectory is spin-stabilized, the same fins may also be initially utilized to retard the rate of spin of the projectile sufficiently to enable these fins to fin-stabilize the shell in the desired manner.

In the purely theoretical type of retractable fins each fin is initially retracted radially in the projectile body or, perhaps more usually, retracted in a dedicated slot or compartment in the projectile body. For the actual deployment function in which the fins flip up or spring up radially there are usually springs incorporated for this purpose. The major disadvantages with this type of fin is that they occupy too much space in the projectile body, and that it is difficult to provide them with sufficient surface area.

A type of fin that occupies significantly less space is the type which initially, i.e. prior to deployment, is retracted snugly curved against and around the projectile body and which, after they are exposed by the ejection of a dedicated protector or the opening of a special retaining device or suchlike, flip up primarily as the result of centrifugal forces.

(If the shell is of a general type that is fitted with a slipping driving band and thus has little or no direct inherent spin it will be primarily air resistance forces that power fin deployment.) Fins of this type are usually mounted in the projectile so that at deployment they also rotate around a retaining pin located parallel to the longitudinal axis of the projectile after which they are locked in deployed mode. An example of this type of fin, which in its basic form means that the fin retains its convex shape even after deployment, is Swedish patent no. 339646 in which each fin can be comprised of a piece of sheet metal bent convex around its own pivot and deployment pin. With this type of fin the surface area of the fin usually poses no problem, but on the other hand it is essential to protect the fins while in retracted mode from the gas pressure in the barrel during firing of the projectile. If the propellant gas pressure in the barrel during firing penetrates under the fins the force acting on the fins will be so great that they will deploy too early and too rapidly, resulting in their destruction when exiting the muzzle. In the case of a gas-tight but insufficiently strong protector, the protector would be deformed to such an extent that it would be impossible to eject thus disenabling fin deployment. On the other hand, if the fin protector was made sufficiently gas-tight and stable so as to protect the fins completely it would be far too heavy, costly, and occupy too much space.

In both the Swedish patents 7908002-4 and 8200312-0 two very similar designs are described for base-bleed shells that are initially spin-stabilized, both incorporating fins of the type indicated above but with a somewhat different detail design wherein both are designed to deploy in conjunction with the ejection of the base-bleed unit, and thus subsequently assume a stabilizing function. In both these cases the gas pressure problem during firing has been avoided by locating the fins prior to deployment forward of the driving band, i.e. away from the section of the shell that is subjected to maximum gas pressure. It is, however, not always possible to choose this apparently simple solution to the problem since in reality it is often other criteria that determine where the driving band shall be located along the length of the shell (projectile). As the shell is subjected to its greatest load at the cross-section through the driving band it is usually also necessary to ensure that the shell is extremely resistant to deformation at this point, and it is thus often this requirement that finally determines the location of the driving band.

The purpose of the present invention is that for such shells that are fin-stabilized—at least during part of their trajectory—to offer a method and a device to enable the driving band to be located at the optimal position on the shell with regard to general functionality and design without negatively affecting the retracted fins of the shell during the firing phase, which fins are assumed to be convexedly wrapped around the outer periphery of the projectile body and are initially covered by a fin protector. Previously it was standard practice to allow such fins to have a convex shape when retracted around the projectile body to retain their convex form even after deployment. But now that it is possible to obtain material with a sufficiently high degree of elasticity and inherent springback it is possible to manufacture fins which can remain curved against the projectile body in the way indicated above for years, and which still resume an essentially flat shape as soon as they are released/deployed. It is this type of fin to which the present invention primarily relates since it provides certain aerodynamic and other advantages.

As a rule the fins of fin-stabilized projectiles are angled a few degrees relative to the longitudinal axis of the projectile to impart an inherent low rate of spin of the fin-stabilized projectile. Such a slight angling of the fins may also be incorporated in the above indicated type where the fins are retracted again the projectile body, and when deployed whose virtually flat form is achieved by the elasticity and good inherent springback of the material. This slight angling of the fins can also be used to provide deployment force to the fins in the case of projectiles fired with low or no spin at all, such as when fired from a smooth-bore barrel. An equivalent angling of the fins can also be achieved by slightly angling the pivot pin of each fin relative to the longitudinal axis of the projectile.

A special advantage of this method and device as described in the present invention is that it only requires the fins when retracted to be surrounded by an ejectable fin protector of limited material thickness and mass. The basic idea behind the present invention is that the internal volume of the fin protector that initially surrounds the fins that are retracted snugly curved around the outer periphery of the shell, excluding the space occupied by the fins, is completely filled with some sort of appropriate inert, non-combustible, non-glutinous substance with low compressibility and very low inherent strength. For example, there are certain bi-component silicones, including some sold under the name SEALGAARD, that meet these requirements. Another conceivable substance would be a suitable fluid—in the first instance a thixotropic fluid since this would preclude any risk of leakage during depot storage. Another suitable fluid would be water.

With even a relatively lightly dimensioned fin protector filled in this way with a virtually non-compressible substance that completely surrounds the retracted fins, the fins are not susceptible to any kind of damage. Naturally, the fin protector must be fully sealed but it is perfectly adequate for it to be made of small gauge (i.e. limited wall thickness) material as it will withstand extremely high external pressure without suffering deformation that would prevent ejection when the time comes and without any deformation of the enclosed fins. The method indicated above for filling the fin protector also prevents the ingress of propellant gases under the fins which would lead to an excessively rapid opening/deployment of the fins. This means in turn that, as previously mentioned, the driving band of the shell can be located at the optimal position irrespective of whether or not the fin protector and the retracted fins inside are located on the section of the shell that is most affected by the propellant gases. According to the present invention deployment of the fins requires only ejection of the fin protector in question after which, depending on the design of the shell and how it is fired, various combinations of the force with which the fins spring out from their retracted mode, centrifugal forces, and air resistance jointly force the fins outwards to their deployed mode while simultaneously slinging the low inherent strength protective substance from the shell body and fins. The method of using an ejectable fin protector to actuate fin deployment also has the advantage that the same function can also be used to remove, for example, a burnt-out or otherwise no longer desirable base-bleed unit.

Figure 2:
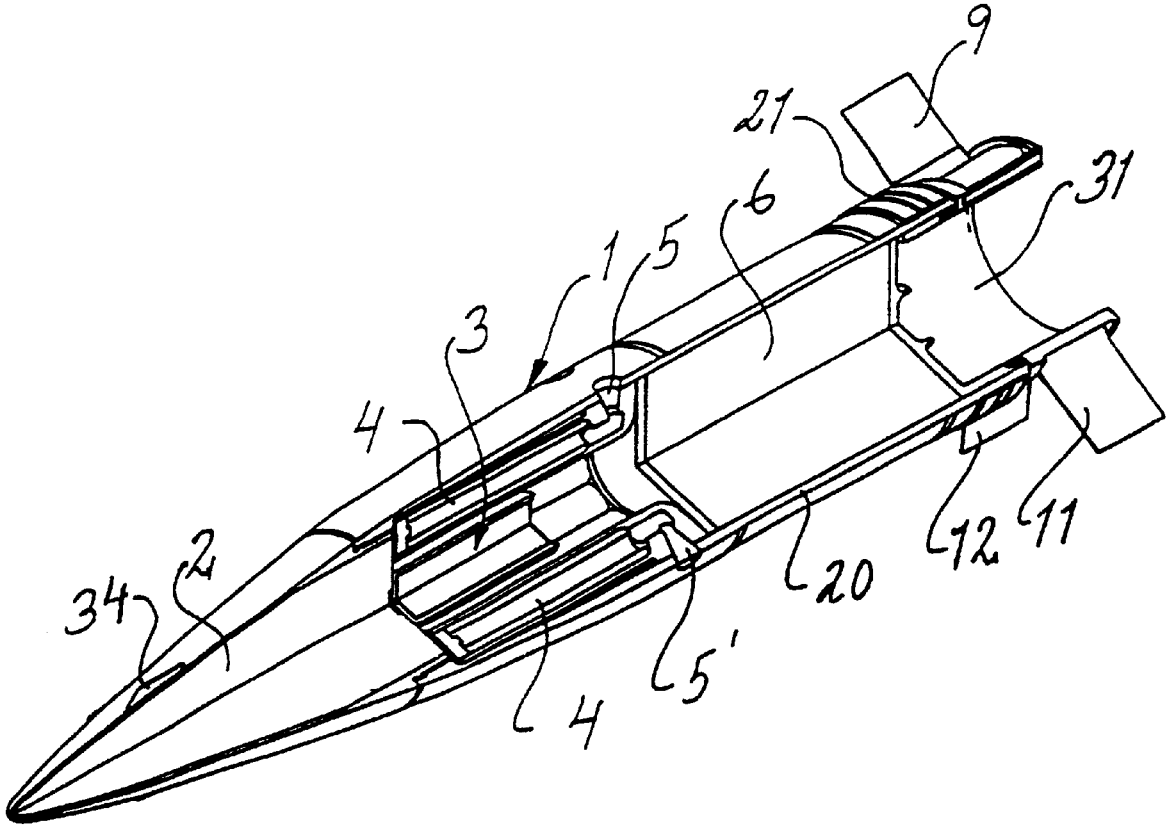
Figure 3:
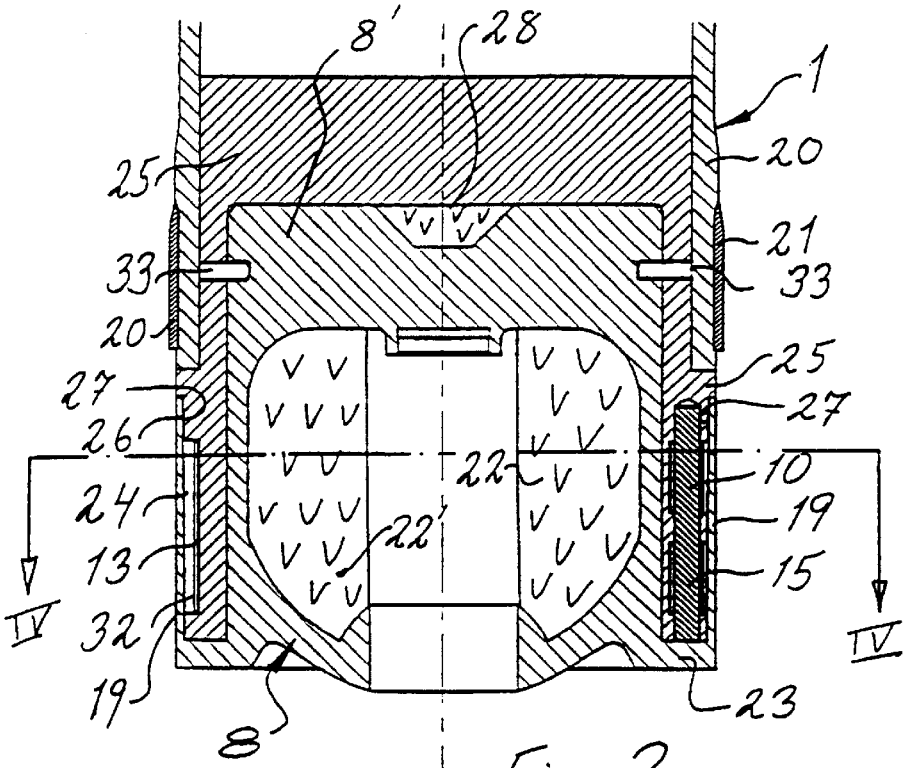
Figure 4:
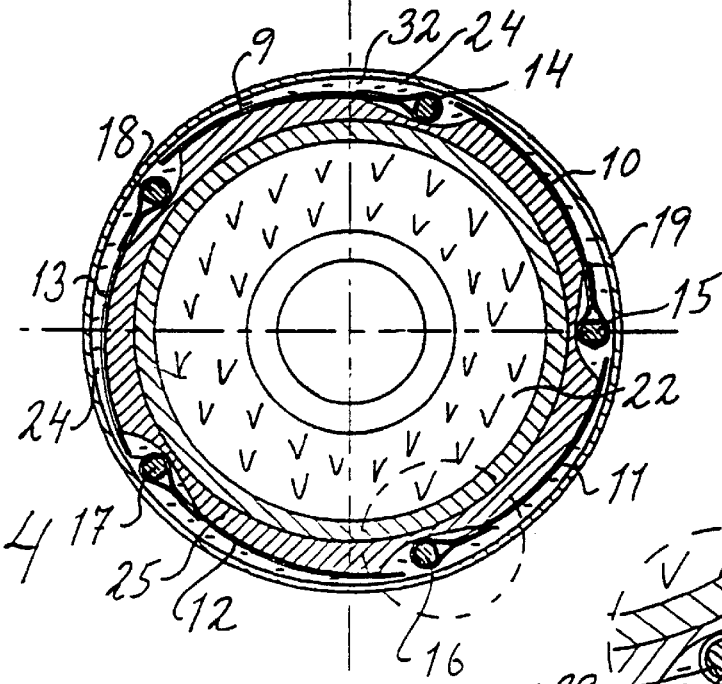
Figure 5:
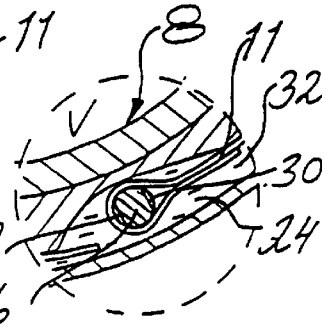
Figure 6:
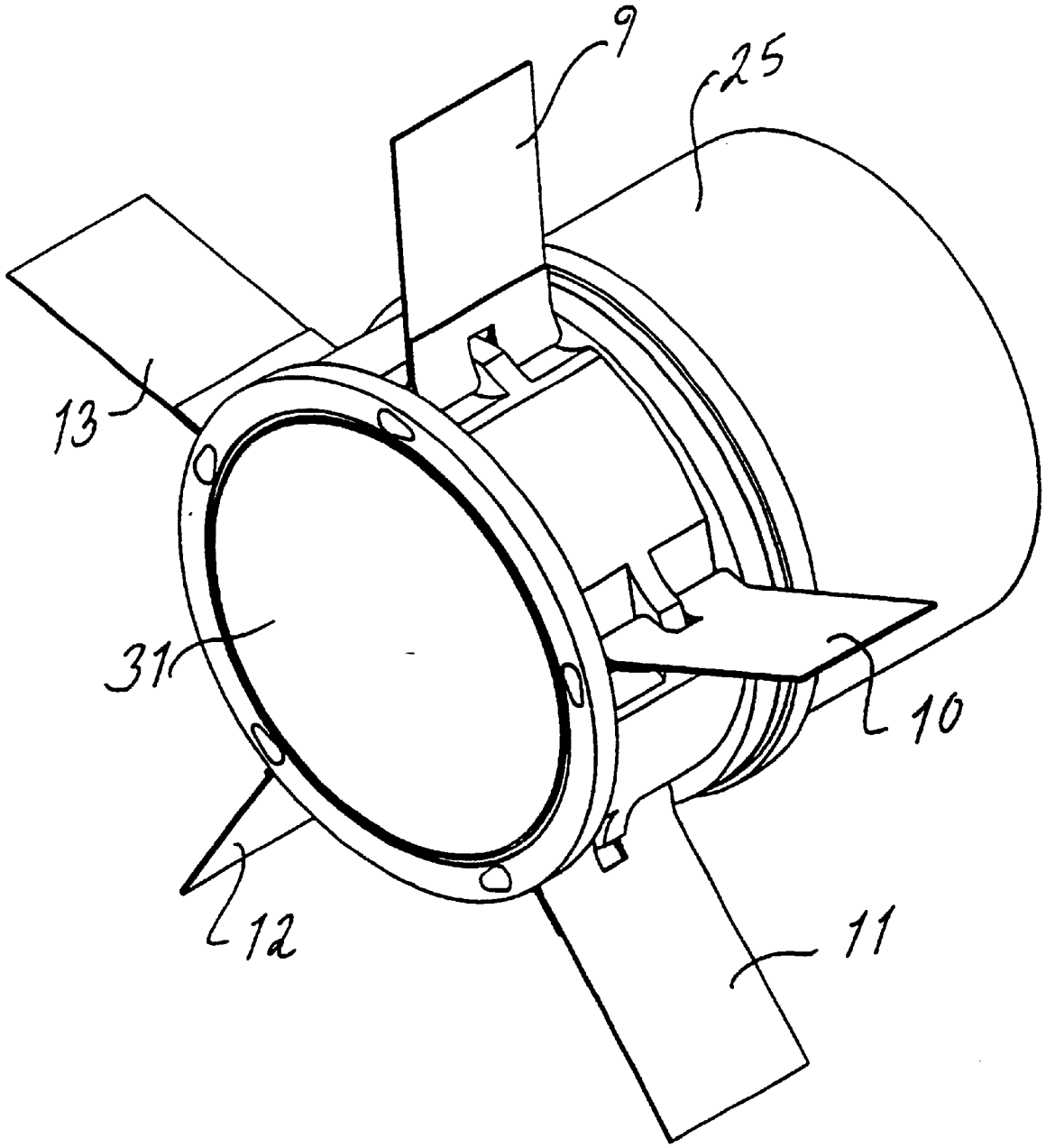

The present invention is defined in the following disclosure, and is described in somewhat more detail in the appended figures in which:

FIG. 1 shows a longitudinal section—immediately after firing—of an artillery shell of the type that could be relevant in connection with the present invention, while FIG. 2 shows the same shell after fin deployment, FIG. 3 is to a larger scale with more parts visible and shows a longitudinal section through the tail unit of the shell shown in FIG. 1, while FIG. 4 shows section IV—IV in FIG. 3, while FIG. 5 shows an enlargement of the circled sector marked in FIG. 4, and finally FIG. 6 shows an oblique projection of the tail unit of the shell shown in FIG. 2, i.e. the aft housing with fin protector removed and all fins deployed. Note that the shell body is not illustrated in this figure.

Parts shown on more than one figure have the same designation irrespective of the scale used and the section illustrated.

The shell 1 illustrated in the figures is a TCM shell, i.e. a shell whose ballistic trajectory can be corrected while the shell is travelling towards its target (TCM=Trajectory Correctable Munitions). The main parts of the shell 1 are the electronics package 2 containing the electronics required for correcting the trajectory and other functions, a control unit 3 containing a number of propellant-driven thrusters 4 of known type which implement trajectory corrections as commanded by the electronics package, each such thruster incorporating a nozzle 5 which is protected by an ejectable plug 5' until the thruster is fired, a cargo section 6 for accommodating a cargo not described herein, such as bomblets/submunitions, and finally a tail unit 7 containing primarily a base-bleed unit 8, fins 9–13 and their hinge pins 14–18. The base-bleed unit 8 is permanently integrated with the fin protector 19. The shell illustrated in FIGS. 1 and 2 also incorporates spin-retarding nubs 34.

FIGS. 3 through 6 show the fin protector, fins, and base-bleed unit in more detail.

As illustrated in FIG. 3, for example, the shell 1 in the example in question has a relatively thin outer casing 20 and a during band 21 made of copper or the equivalent, and is otherwise constructed in accordance with conventional techniques. The relative thinness of the shell 1 body is primarily a direct result of the fact that the shell in question is designed to carry a number of bomblets/submunitions to the intended target, but this factor is of no significance in the context of the present invention. On the other hand, the design of the base-bleed unit 8 and the attached fin protector 19 is important. The base-bleed unit 8 is designed with an internal combustion chamber 22 which initially contains a slow-burning special propellant 22'. The rear (relative to the direction of flight of the shell) wall of the base-bleed unit combustion chamber ends with a flange 23 which is integral with the fin protector 19, which in turn extends forwards in the direction of flight of the shell from the flange parallel with the outer wall of the base-bleed unit 8. Between this outer wall of the base-bleed unit 8, combustion chamber, and the inside of the fin protector 19 there is a ring-shaped space 24. Initially the base-bleed unit 8 is housed in the designated space 31 in the tail unit 7 of the shell 1. In the figures this space 31 for the base-bleed unit is in a separate aft housing 25 permanently integrated with the outer casing 20 of the shell 1. The aft housing 25 is similar in shape to a cylindrical can in whose outer rear wall the fins 9–13 are mounted via their hinge pins 14–18. The fins 9–13 are initially retracted against the outer curved surface of the outer wall of the aft housing 25, while those parts of the aft housing 25 in which the fins are mounted are recessed in the above mentioned ring-shaped space 24, and the inner surface of the fin protector 19 closest to the free overlap surface 26 forms a pull-off overlapping seal with the sealing surface 27. The ring shaped space 24 that is not occupied by the aft housing 25, the fins 9–13 and their hinge pins 14–18 are, in initial mode, filled with the above described inert and low inherent strength substance 32 which has the task of preventing the fin protector and fins from being deformed to such an extent that they can no longer perform their respective functions.

The space designated 28 in FIG. 3 contains a small base-bleed ejector charge which on command ejects the base-bleed unit 8, thereby also removing the integral fin protector 19. The shear pins 33 shear off when the base-bleed unit is ejected.

As shown in FIG. 3 the thickness of the homogeneous shell wall where the driving band 21 is located is considerable. The aft wall 8' of the base-bleed unit is similarly reinforced. The homogeneous material in this cross-section is critical as it is precisely this cross-section of the shell which is subjected to the greatest lateral load during firing.

Another detail worthy of mention is that the hinge pins of the fins each have two flat surfaces diametrically opposite each other which constitute two locking flats, designated 29 and 30 in FIG. 5, radial to the cross-section of the shell. By pretensioning the fold of the fins around their respective hinge pins so that the sheet metal of each fin has a spring force that pinches the fold of the fin around each hinge pin, the locking flats provide an elementary but adequate locking of the fins in deployed mode after they have swung out by pivoting around the stationary hinge pins.

We claim:

1. A method for a shell that is fin-stabilized at least during a final part of a flight trajectory of said shell, for preventing deformation of deployable fins incorporated in a tail unit of said shell, said method comprising the steps of:

providing a shell that is fired from a gun barrel where the shell is subjected to the full effect of propellant gas pressure in the gun barrel during a firing phase;

protecting said fins during a firing phase of said shell by a fin protector with limited wall thickness, said fin protector surrounding a rear section of said shell and being ejected at a point in time for fin deployment;

designing said fin protector to join an external surface of said shell at a sealed interface, said fin protector being separable from said shell at said interface; and filling a ring-shaped space, within said fin protector and not occupied by said fins, completely with an inert, non-combustible, non-glutinous substance of low compressibility and very low inherent strength.

2. The method of claim 1, wherein said substance has such properties that after fin deployment none of said substance is able to remain on the fins or a body of the shell.

3. The method of claim 1, wherein said substance comprises a bi-component, curing silicone with low inherent strength in a cured state.

4. The method of claim 1, wherein said substance comprises a fluid.

5. The method of claim 4, wherein said fluid is water.

6. The method of claim 1, wherein said substance comprises a thixotrope fluid with low inherent strength and low compressibility.

7. A shell that is fin-stabilized at least during a final part of a flight trajectory of said shell including a device for preventing deformation of deployable fins incorporated in a tail unit of said shell, said tail unit being subject to a full effect of a propellant gas pressure in a barrel used for firing said shell, comprising:

a shell comprising deployable fins incorporated in a tail unit;

an ejectable fin protector with limited wall thickness, said fin protector being insufficient to independently resist said gas pressure, and being formed as a sleeve open at a front location but completely closed at a rear location;

said fin protector surrounding said tail unit until a point in time when said fin protector is ejected and said fins are deployed, and being joined with a gas-tight but breakable seal with a body of said shell; and a ring-shaped free space within said protector, not occupied by said fins, said free space being completely filled with an inert, non-combustible, non-glutinous substance of low compressibility and very low inherent strength.

8. The shell of claim 7, wherein said fin protector is permanently joined to a base-bleed unit of said shell so that said fin protector and said base-bleed unit are ejected together.

9. The shell of claim 7, wherein a base-bleed unit of said shell and said fin protector form a combined unit, said base-bleed unit being located in the center of said fin protector so that a ring-shaped space is formed between said base-bleed unit and said fin protector, said space being initially occupied by said tail unit and said fins, and said fins initially being retracted convexedly around an outer surface of said tail unit.

10. The shell of claim 7, wherein said fins are made of sheet-metal material with very high elasticity and long-term form memory, each fin being bent around its own hinge pin immovably secured longitudinally in said shell body, each said hinge pin incorporating two diametrically opposite longitudinal locking flats radially located relative to a cross-section of said shell, wherein said bending of each fin around each hinge pin is such that the fin pinches the hinge pin.

11. The shell of claim 7, wherein said substance comprises a bi-component, curing silicone with low inherent strength in a cured state.

12. The shell of claim 7, wherein said substance comprises a fluid.

13. The shell of claim 12, wherein said fluid is water.

14. The shell of claim 7, wherein said substance comprises a thixotrope fluid with low inherent strength and low compressibility.

* * * * *